US007648221B2

(12) United States Patent
Ito

(10) Patent No.: US 7,648,221 B2
(45) Date of Patent: Jan. 19, 2010

(54) DROPLET EJECTING APPARATUS AND THICKNESS ESTIMATING METHOD

(75) Inventor: Atsushi Ito, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 218 days.

(21) Appl. No.: 11/980,274

(22) Filed: Oct. 30, 2007

(65) Prior Publication Data

US 2008/0100659 A1 May 1, 2008

(30) Foreign Application Priority Data

Oct. 30, 2006 (JP) ..... 2006-293716

(51) Int. Cl.
*B41J 29/393* (2006.01)
*B41J 2/05* (2006.01)

(52) U.S. Cl. ..... 347/19; 347/65

(58) Field of Classification Search ..... 347/49, 347/71

See application file for complete search history.

(56) References Cited

U.S. PATENT DOCUMENTS

2005/0122380 A1* 6/2005 Nakamura et al. ..... 347/65

FOREIGN PATENT DOCUMENTS

JP 5104711 4/1993
JP 6191021 7/1994
JP 2001241934 9/2001
JP 2004142296 5/2004
JP 2005-161761 6/2005

* cited by examiner

*Primary Examiner*—Matthew Luu
*Assistant Examiner*—Lisa M Solomon
(74) *Attorney, Agent, or Firm*—Reed Smith LLP

(57) ABSTRACT

A droplet ejecting apparatus, including: a head unit including (a) a cavity unit constituted by plate members stacked on and adhered to each other, having a first and a second outer surface respectively defined by a first and a second outermost plate member of the plate members which are opposite to each other and one of which has nozzles, and having liquid flow channels formed therein and respectively communicating with the nozzles, and (b) an actuator attached to the cavity unit and operable such that the head unit ejects droplets through the nozzles, a holder holding the head unit, a reinforcing plate adhered to the cavity unit so that the holder holds the head unit, an adhesive layer between the first outer surface and a first surface of the reinforcing plate as one of opposite surfaces thereof so as to adhere the cavity unit and the reinforcing plate to each other, and having a non-adhesive area in which no adhesive exists, and a measuring section configured such that a measurement for estimating a thickness of the adhesive layer by using the non-adhesive area is performed therein.

11 Claims, 11 Drawing Sheets

DROPLET EJECTING APPARATUS AND THICKNESS ESTIMATING METHOD

CROSS REFERENCE TO RELATED APPLICATION

The present application claims priority from Japanese Patent Application No. 2006-293716, which was filed on Oct. 30, 2006, the disclosure of which is herein incorporated by reference in its entirety.

BACKGROUND OF THE INVENTION

1. Field of the Invention

The present invention relates to a droplet ejecting apparatus configured such that a head unit which ejects droplets by driving of an actuator is mounted on a head holder via a reinforcing plate. Further, the present invention relates to a method for estimating a thickness of an adhesive layer which adheres the head unit and the reinforcing plate to each other.

2. Description of the Related Art

There is conventionally known an ink-jet recording apparatus, as a droplet ejecting apparatus of the above-described type, in which a recording operation is performed on a recording medium with ink droplets ejected by a head unit that is reciprocated while being opposed to the recording medium. The head unit is attached to a reinforcing plate as disclosed by Japanese Patent Application Publication No. 2005-161761, and is mounted as a unit with the reinforcing plate on a head holder. FIG. 10A is an explanatory view of the head unit and the reinforcing plate of the above-described conventional ink-jet recording apparatus. FIG. 10B is an explanatory view of the head unit to which the reinforcing plate is adhered, as seen from a lower side of the head unit. FIG. 11A is a cross-sectional view showing a cross section of FIG. 10B taken along a line A-A with a portion thereof omitted. FIG. 11B is an explanatory view of the reinforcing plate that is upwardly warped at its end portion.

As shown in FIG. 10A, the head unit 30 includes a cavity unit 50 in which a plurality of ink flow channels are formed and a piezoelectric actuator 40 bonded to an upper surface of the cavity unit 50. Ink supply holes 31*a*, 31*b*, 31*c*, 31*d* for supplying inks to the ink flow channels are formed in the head unit 30. As shown in FIG. 11A, the cavity unit 50 is constituted by eight plate members 31, 32, 33, 34, 35, 36, 37, 38 stacked on each other. The plate members are adhered to each other with adhesive sheets (not shown). The head unit 30 is fixed to a head holder (indicated at "9" in FIG. 3) via the reinforcing plate 60. The reinforcing plate 60 has effects of enhancing a rigidity of the head unit 30 and preventing a cross talk by suppressing vibrations of the cavity unit 50 which are generated upon driving of the piezoelectric actuator 40. The cross talk is a phenomenon that vibrations generated upon ejection propagate among rows of nozzles. The reinforcing plate 60 is wider than the head unit 30. The reinforcing plate 60 has an opening portion 60*e* for exposing the piezoelectric actuator 40 of the head unit 30 adhered to the reinforcing plate 60. Reference numerals 60*a*, 60*b*, 60*c*, 60*d* indicate ink supply holes for supplying the inks to the respective ink supply holes 31*a*-31*d* of the head unit 30.

The reinforcing plate 60 is adhered to the head unit 30 with an adhesive sheet 2. The adhesive sheet 2 has adhesive surfaces as upper and lower surfaces thereof and has a plan-view shape corresponding to a plan-view shape of the cavity unit 50. In a step in which the head unit 30 and the reinforcing plate 60 are adhered to each other, initially, the adhesive sheet 2 is pressed against a lower surface of the reinforcing plate 60.

Then, an upper surface 31*i* of the head unit 30 is positioned to coincide with the lower surface of the adhesive sheet 2 and is pressed against the lower surface of the reinforcing plate 60.

Meanwhile, the present inventor has found that the adhesive sheet 2 has the effect of preventing the cross talk among the nozzles by absorbing, owing to a flexibility of a material of the adhesive sheet 2, the vibrations of the cavity unit 50 that is generated upon vibrations of the piezoelectric actuator 40. Further, the present inventor has found that a resonance phenomenon which adversely affects the suppression of the cross talk occurs if a thickness of the adhesive sheet 2 does not fall within a predetermined range.

Thus, the present inventor has had an idea that a control of the thickness of the adhesive sheet 2 is an important problem and decided to control the thickness in the following method. Initially, as shown in FIG. 11A, the cavity unit 50 to which the reinforcing plate 60 is bonded is placed on a stand for measurement, such that the reinforcing plate 60 is lower than the cavity unit 50. Then, a reference position H2 for measurement is set at a position higher than the cavity unit 50, and a distance D12 from the reference position H2 to a lower surface 60*h* of the reinforcing plate 60 is measured. Subsequently, a distance D11 from the reference position H2 to the cavity unit 50 (i.e., a nozzle surface 38*p* of a nozzle plate 38) is measured. Then, a thickness D13 of the cavity unit 50 including the adhesive sheet 2 is determined by subtracting the distance D11 from the distance D12 (D13=D12−D11). Next, a thickness D4 of the adhesive sheet 2 is determined by subtracting a designed or nominal thickness D14 of the cavity unit 50 from the thickness D13 (D4=D13−D14). Then, whether the thickness D4 of the adhesive sheet 2 falls within the predetermined range is judged.

SUMMARY OF THE INVENTION

However, the above-described conventional ink-jet recording apparatus has variations in thickness of the plate members constituting the cavity unit 50 and variations in thickness of the adhesive layers each interposed between adjacent two of the plate members. Thus, the designed or nominal thickness D14 of the cavity unit 50 varies. Therefore, the conventional ink-jet recording apparatus suffers from a problem that the thickness of the adhesive sheet 2 cannot be accurately obtained. In addition, as shown in FIG. 11B, the reinforcing plate 60 may be warped at its end portion by a pressure applied to the reinforcing plate 60 when adhered to the head unit 30. Thus, the distance D12 from the reference position H2 to the lower surface 60*h* of the reinforcing plate 60 is short by an error AD. This also causes the problem that the thickness of the adhesive sheet 2 cannot be accurately obtained.

This invention has been developed in view of the above-described situations, and it is an object of the present invention to provide a droplet ejecting apparatus and an estimating method which assures that a thickness of an adhesive layer interposed between a head unit and a reinforcing plate can be accurately obtained.

The object indicated above may be achieved according to a first aspect of the present invention which provides a droplet ejecting apparatus, comprising: a head unit including (a) a cavity unit constituted by a plurality of plate members stacked on each other and adhered to each other with an adhesive, having a first outer surface and a second outer surface respectively defined by a first outermost plate member and a second outermost plate member of the plurality of plate members which are opposite to each other and one of which has a plurality of nozzles, and having a plurality of liquid flow channels formed therein and respectively communicating with the plurality of nozzles, and (b) an actuator attached to the cavity unit and operable such that the head unit ejects droplets through the plurality of nozzles; a holder which holds the head unit; a reinforcing plate which is adhered to the cavity unit of the head unit so that the holder holds the head unit, an adhesive layer interposed between the first surface of the cavity unit and a first surface of the reinforcing plate as one of opposite surfaces thereof so as to adhere the cavity unit and the reinforcing plate to each other, and having a non-adhesive area in which no adhesive exists; and a measuring section configured such that a measurement for estimating a thickness of the adhesive layer by using the non-adhesive area is performed therein. More specifically, the droplet ejecting apparatus may include first and second preferred forms. According to the first preferred form, the measuring section may include a through hole provided in the first outermost plate member at a position corresponding to the non-adhesive area of the adhesive layer, and may be configured such that a measurement by using the through hole as the measurement for estimating the thickness of the adhesive layer is performed in the measuring section, for example. According to the second preferred form, the measuring section may include a through hole provided in the reinforcing plate at a position corresponding to the non-adhesive area of the adhesive layer, and a measurement by using the through hole, as the measurement for estimating the thickness of the adhesive layer, may be performed in the measuring section, for example.

To achieve the object indicated above, the following methods, according to a second aspect of the present invention, for estimating the thickness of the adhesive layer may be applied to the above-described droplet ejecting apparatus according to the first aspect of the present invention. One of the methods is a method for estimating the thickness of the adhesive layer of the droplet ejecting apparatus as the first preferred form, comprising steps of: measuring, in the measuring section, a distance to the first surface of the reinforcing plate from a reference position that is not nearer to the reinforcing plate than the second outer surface of the cavity unit, in a direction perpendicular to the first outer surface of the cavity unit; measuring, in the measuring section, a distance from the reference position to a back surface of the first outermost plate member opposite to a surface thereof providing the first outer surface of the cavity unit, in the direction perpendicular to the first outer surface of the cavity unit; and estimating the thickness of the adhesive layer based on the measured distance to the first surface of the reinforcing plate from the reference position, the measured distance from the reference position to the back surface of the first outermost plate member, and a thickness of the first outermost plate member. Another of the methods is a method for estimating the thickness of the adhesive layer of the droplet ejecting apparatus as the second preferred form, comprising steps of: measuring, in the measuring section, a distance to the first outer surface of the cavity unit from a reference position that is not nearer to the cavity unit than a second surface of the reinforcing plate opposite to the first surface thereof, in a direction perpendicular to the first outer surface of the cavity unit; measuring, in the measuring section, a distance from the reference position to the second surface of the reinforcing plate, in the direction perpendicular to the first outer surface of the cavity unit; and estimating the thickness of the adhesive layer based on the measured distance to the first outer surface of the cavity unit from the reference position, the measured distance from the reference position to the second surface of the reinforcing plate, and a thickness of the reinforcing plate. The other of the methods is a method for estimating the thickness of the adhesive layer of the droplet ejecting apparatus as the second preferred form, comprising steps of: measuring, in the measuring section, a distance to the first outer surface of the cavity unit from a second surface of the reinforcing plate opposite to the first surface thereof, in a direction perpendicular to the first outer surface of the cavity unit; and estimating the thickness of the adhesive layer based on the measured distance to the first outer surface of the cavity unit from a second surface of the reinforcing plate and a thickness of the reinforcing plate.

The apparatus and the methods can be configured to permit a measurement which is not affected by, e.g., variations in thickness of the adhesive interposed between the plurality of plate members constituting the head unit, and can be configured to permit a measurement which is not affected by, e.g., a warp of an end portion of the reinforcing plate. These configurations permit an accurate measurement of the thickness of the adhesive layer.

BRIEF DESCRIPTION OF THE DRAWINGS

The above and other objects, features, advantages, and technical and industrial significance of the present invention will be better understood by reading the following detailed description of preferred embodiments of the invention, when considered in connection with the accompanying drawings, in which.

DESCRIPTION OF THE PREFERRED EMBODIMENTS

First Embodiment

Hereinafter, there will be explained a first embodiment of the present invention that relates to an ink-jet recording apparatus.

[Primary Construction]

Figure 1:
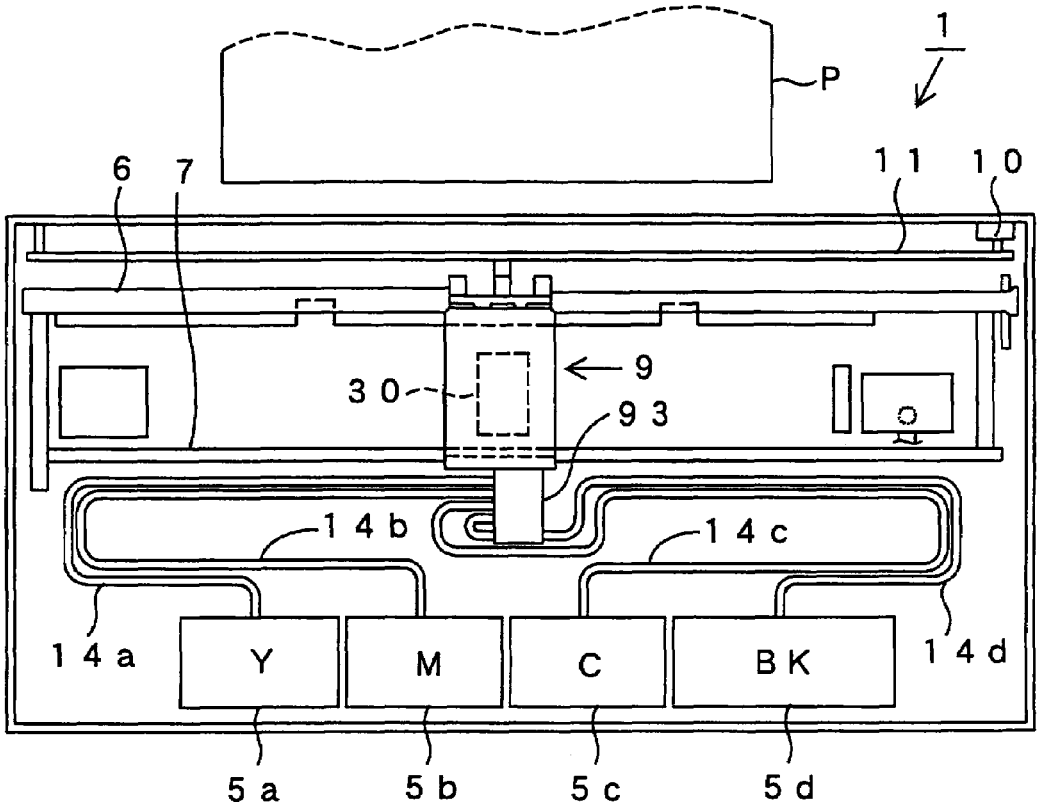
FIG. 1 is an explanatory plan view showing a primary construction of an ink-jet recording apparatus.

Initially, there will be explained a primary construction of an ink-jet recording apparatus 1 with reference to FIG. 1. FIG. 1 is an explanatory plan view showing the primary construction of the ink-jet recording apparatus 1. In the ink-jet recording apparatus 1, two guide rods 6, 7 are provided. A head holder 9 also functioning as a carriage is slidably supported on the guide rods 6, 7. The head holder 9 holds a head unit 30 which performs a recording operation by ejecting ink onto a recording sheet P. The head holder 9 is connected to an endless belt 11 that is circulated by a carriage motor 10. This circulation of the endless belt 11 moves the head holder 9 along the guide rods 6, 7.

In the ink-jet recording apparatus 1, there are provided ink tanks 5*a*, 5*b*, 5*c*, 5*d* respectively storing a yellow ink, a magenta ink, a cyan ink, and a black ink. The ink tanks 5*a*-5*d* are respectively connected to flexible ink supply tubes 14*a*, 14*b*, 14*c*, 14*d*. The respective inks supplied from the ink supply tubes 14*a*-14*d* are introduced into the head unit 30 via a tube joint 93 extending frontward from the head holder 9. A pigment ink or a dye ink may be used as each of the inks.

[Construction of the Head Unit]

Figure 2:
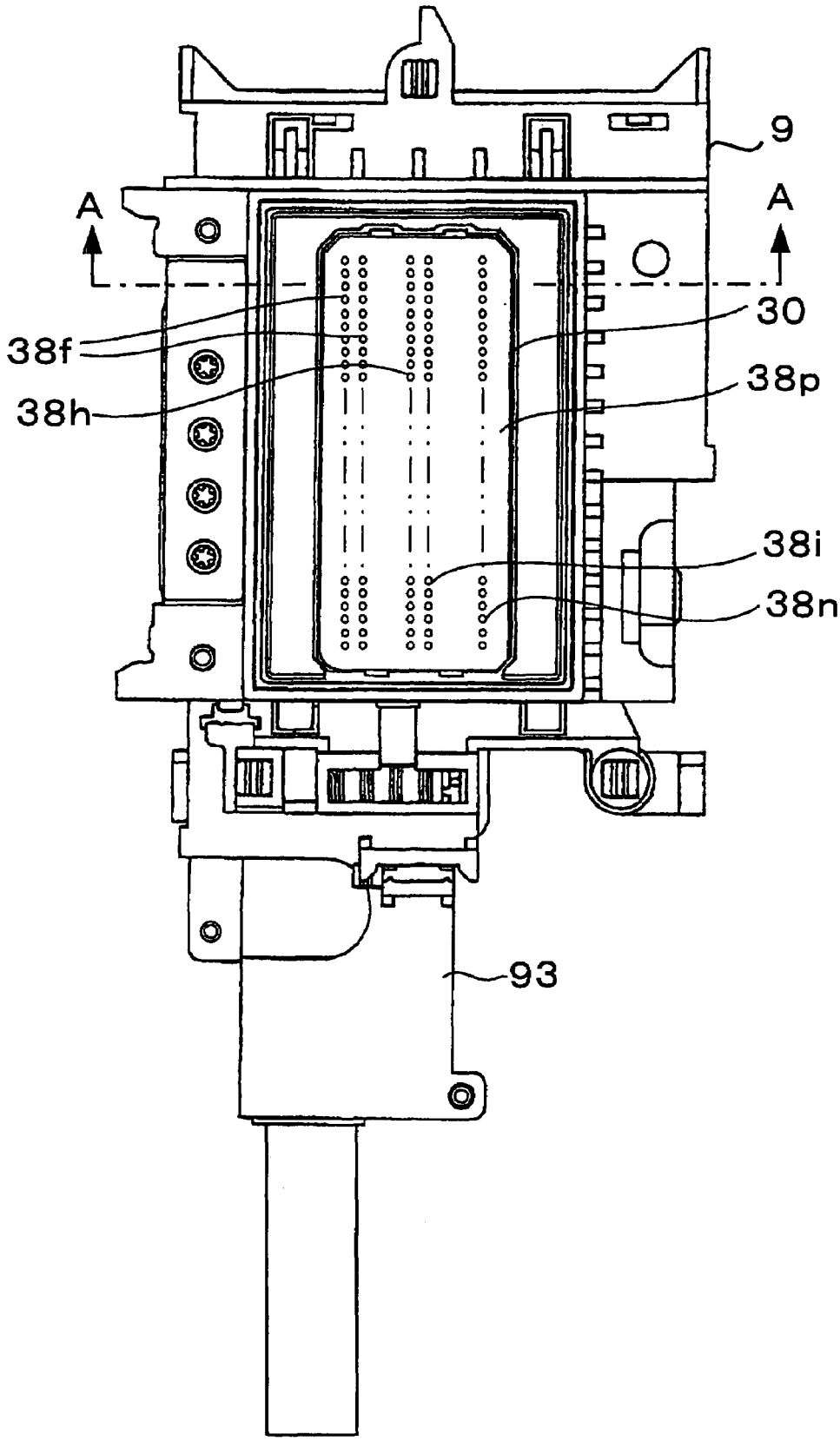
FIG. 2 is a bottom plan view of a head holder as seen from a lower side thereof, showing a nozzle surface as a lower surface of a head unit.
Figure 3:
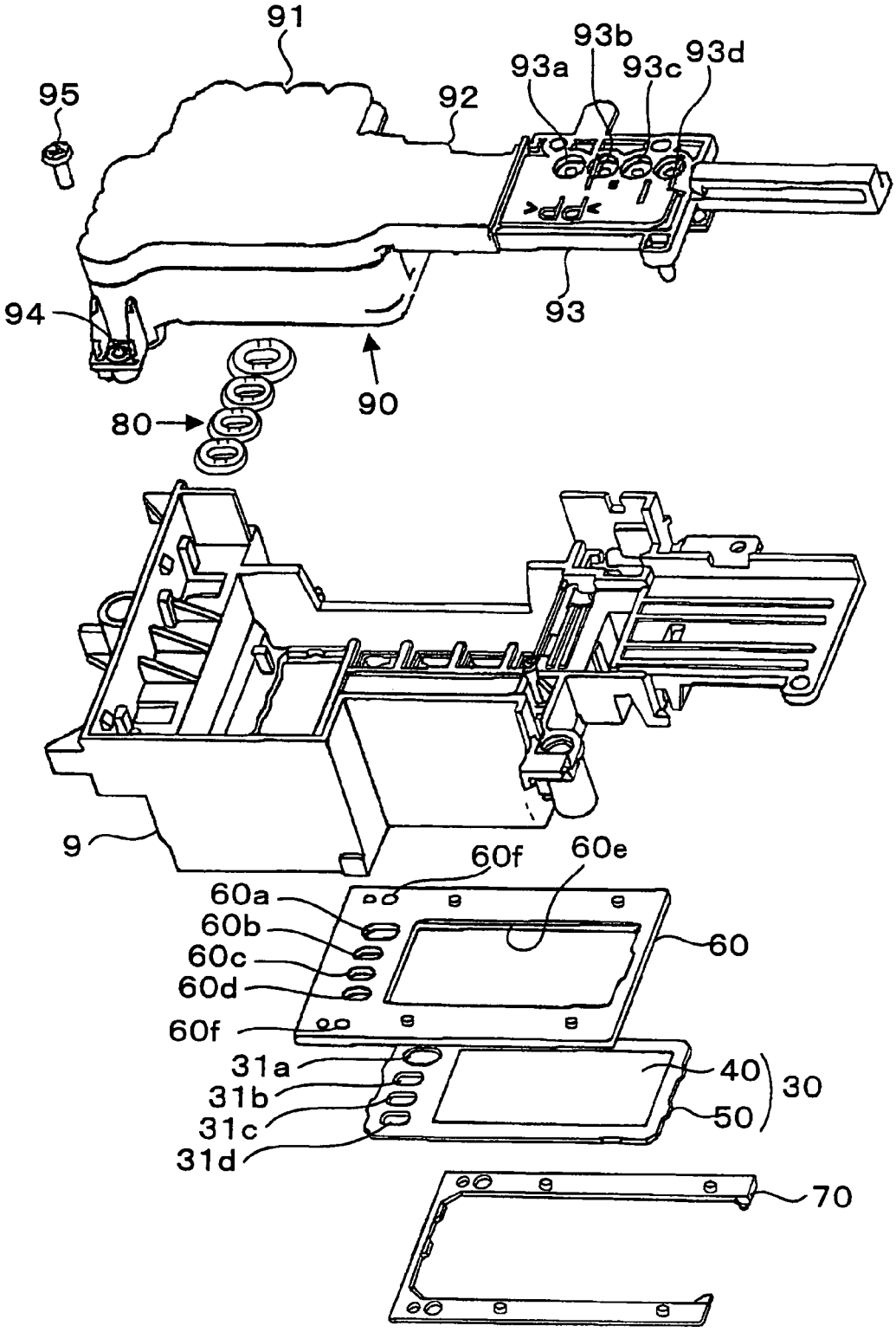
FIG. 3 is an exploded perspective view of the head holder shown in FIG. 2 and parts held by the head holder.
Figure 4:
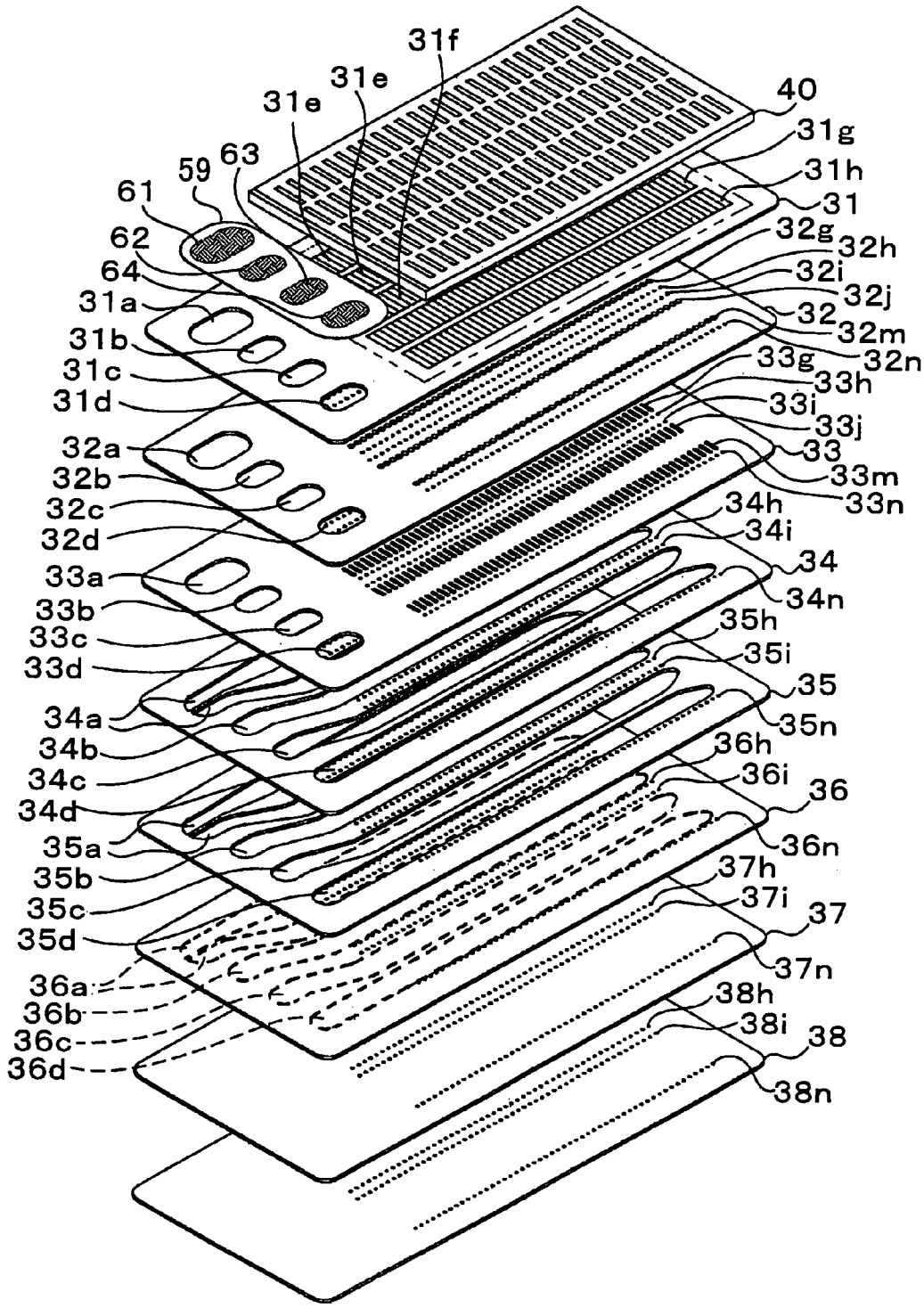
FIG. 4 is a perspective view showing plate members constituting the head unit held by the head holder shown in FIG. 3.
Figure 5:
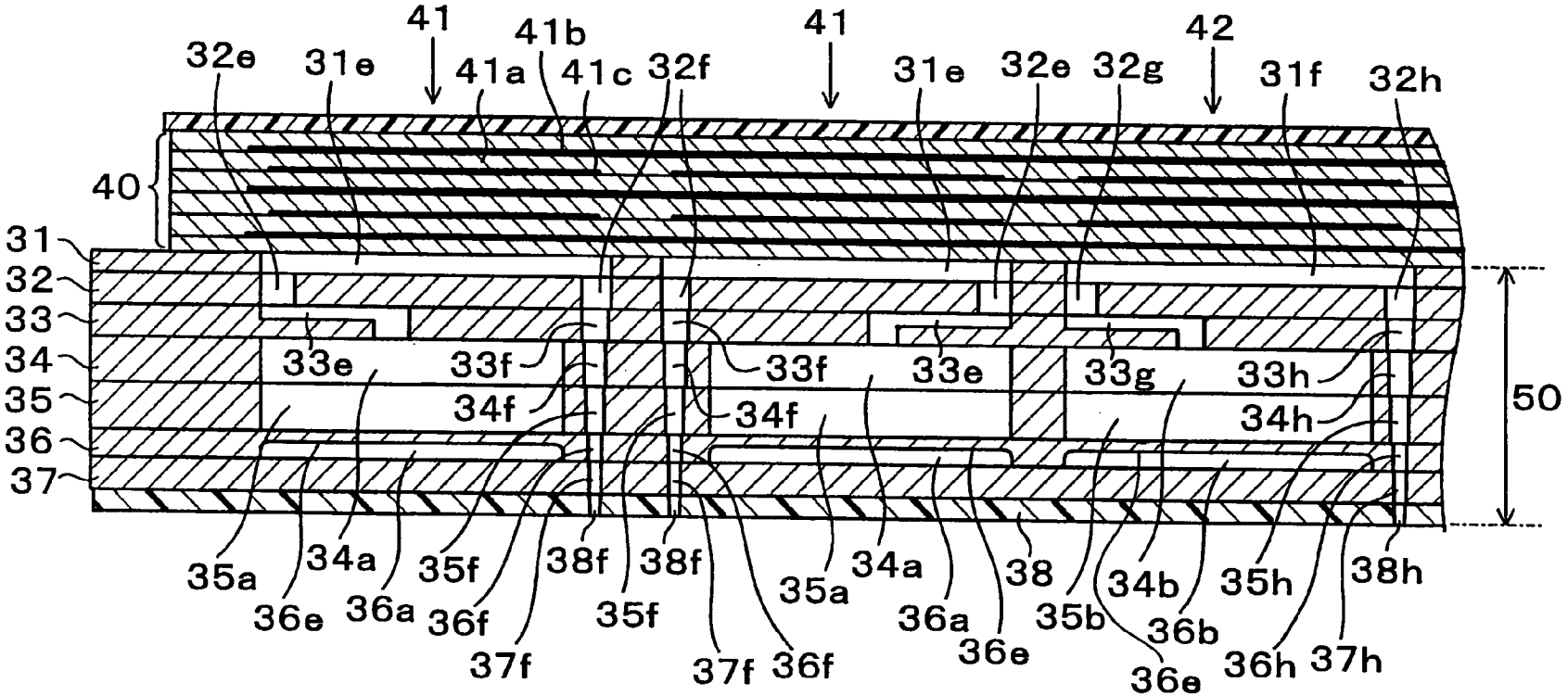
FIG. 5 is an explanatory view showing a cross-section taken along a line A-A of a portion of the head unit held by the head holder shown in FIG. 2.

Next, a construction of the head unit 30 is explained with reference to FIG. 2 through FIG. 5. FIG. 2 is a bottom plan view of the head holder 9 as seen from a lower side thereof, showing a nozzle surface 38*p* as a lower surface of the head unit 30. FIG. 3 is an exploded perspective view of the head holder 9 shown in FIG. 2 and parts held by the head holder 9. FIG. 4 is a perspective view showing members constituting the head unit 30 held by the head holder 9 shown in FIG. 3. FIG. 5 is an explanatory view showing a cross-section taken along a line A-A of a portion of the head unit 30 held by the head holder 9 shown in FIG. 2. In the following description, a downward direction is defined as a direction in which the inks are ejected. In addition, the same reference numerals are used to designate the corresponding elements or parts of the conventional ink-jet recording apparatus shown in FIGS. 10A, 10B and 11A, 11B, and the description thereof will be omitted.

As shown in FIG. 2, there are provided, in the nozzle surface 38*p*, groups of nozzles 38*f*, 38*h*, 38*i*, 38*n* for ejecting the black ink, the yellow ink, the cyan ink, and the magenta ink, respectively. The nozzles of each group are arranged in at least one row so as to extend in a direction perpendicular to a direction in which the head holder 9 is moved (i.e., a main scanning direction). The nozzles 38*f*-38*n* are open downward so as to face an upper surface of the recording sheet P (shown in FIG. 1) as a recording medium.

Figure 6A:
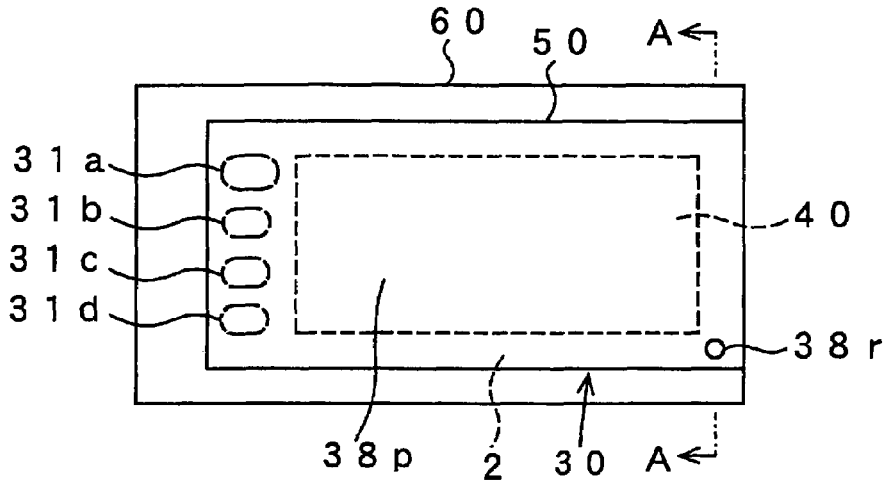
FIG. 6A is an explanatory view of the head unit of a first embodiment to which a reinforcing plate is adhered, as seen from a lower side of the head unit.
Figure 6B:
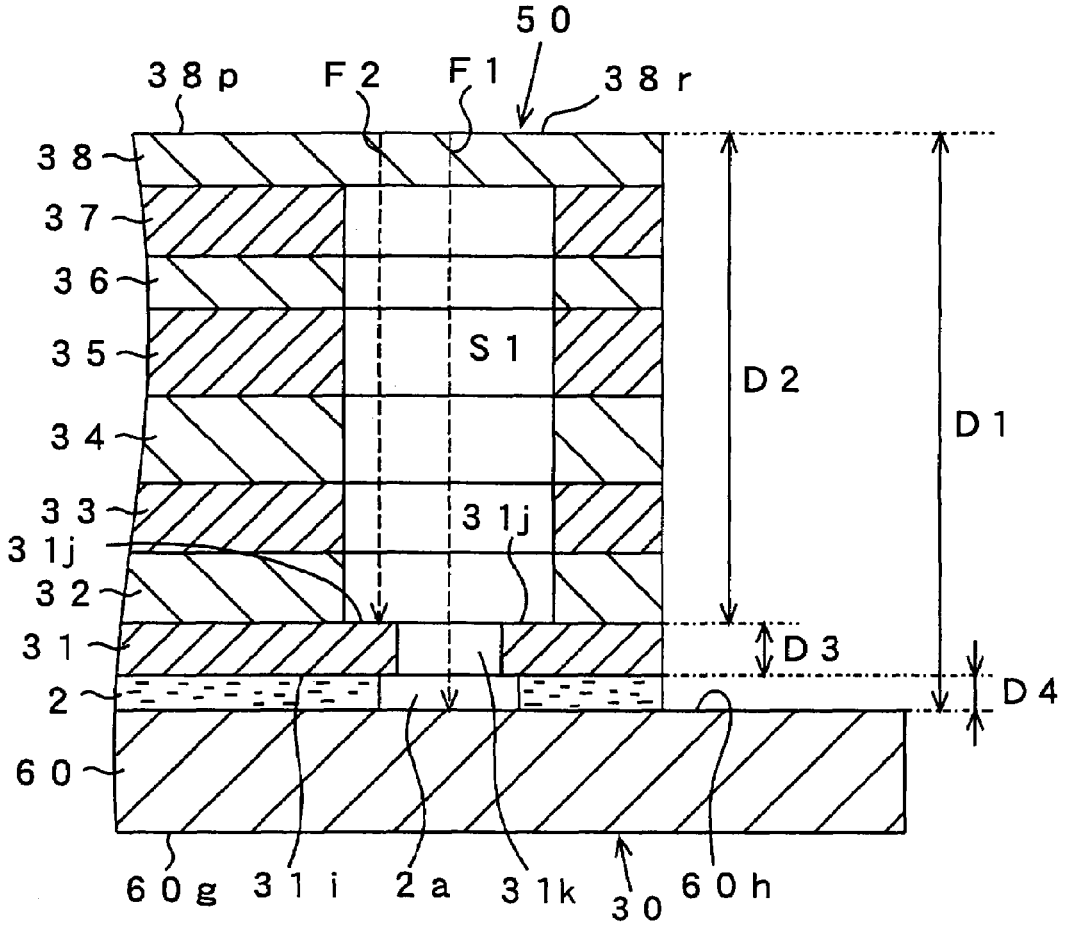
FIG. 6B is a cross-sectional view showing a cross section of FIG. 6A taken along a line A-A with a portion thereof omitted.

As shown in FIG. 3, a frame-shaped reinforcing plate 60 having a higher rigidity than the head unit 30 is adhered to an upper surface of the head unit 30 with an adhesive sheet (indicated at "2" in FIGS. 6A and 6B). A frame 70 is disposed around the head unit 30 and adhered to a lower surface of the reinforcing plate 60 with an adhesive sheet (not shown). Above the head unit 30, there is disposed a buffer tank 90 for storing the inks to be supplied to the head unit 30. Predetermined amounts of air are stored in the buffer tank 90. The air reduces impact forces produced when the head unit 30 is moved or stopped. This reduction prevents fluctuations of pressure in each pressure chamber in the head unit 30, thereby maintaining uniform ink-ejection properties of the nozzles. If the air separated from each ink exceeds the predetermined amount, it is discharged into the outside by an air-discharge device 91 provided for the buffer tank 90.

An arm portion 92 having ink channels therein is formed in an end portion of the buffer tank 90. In the arm portion 92, there are provided ink intakes 93*a*, 93*b*, 93*c*, 93*d* for respectively taking in the inks supplied from the ink tanks 5*a*-5*d* through the tubes 14*a*-14*d*. In a lower surface of the buffer tank 90, there are provided ink supply outlets (not shown) corresponding to the respective inks and formed for supplying the inks from the buffer tank 90 to the head unit 30. A rubber bushing 80 is provided between the ink supply outlets and ink supply holes 60*a*, 60*b*, 60*c*, 60*d* of the reinforcing plate 60. This assures a fluid-tightness between the buffer tank 90 and the reinforcing plate 60. Two insertion holes 94 are formed in opposite side portions of the buffer tank 90. More specifically, one of the insertion holes 94 that is shown in FIG. 3 is formed in one of the side portions, and the other insertion hole 94, not shown, is formed in the other side portion. Mounting screws 95 inserted in the respective insertion holes 94 are screwed in respective screw holes 60*f* formed in the reinforcing plate 60. Thus, the buffer tank 90 is fixed to the reinforcing plate 60.

As shown in FIG. 5, the head unit 30 has a construction in which a piezoelectric actuator 40 is bonded to an upper surface of a cavity unit 50. As shown in FIG. 4, the cavity unit 50 has a laminar structure in which the following eight plate members are stacked on and adhered to each other in the order from the bottom: a nozzle plate 38; a spacer plate 37; a damper plate 36; manifold plates 35, 34; a supply plate 33; a base plate 32; and a cavity plate 31. Each of the plates 31-38 is a thin plate member. The plates 31-38 are adhered to each other with an adhesive (not shown). In the present embodiment, the adhesive is a thermosetting epoxy resin, for instance. The nozzle plate 38 is made of a synthetic resin such as a polyimide. The other plates 31-37 are made of a metal such as a 42 alloy steel (i.e., a 42%-nickel alloy steel) or a stainless steel.

The piezoelectric actuator 40 includes active portions 41, 41 and active portions 42. The active portions 41 generate energy for ejecting the black ink, and the active portions 42 generate energy for ejecting the yellow ink. Although omitted in FIG. 5, there are arranged active portions for generating energy for ejecting the cyan ink, on a right side of the active portions 42. Further, there are arranged active portions for generating energy for ejecting the magenta ink, on a right side of the active portions for the cyan ink. It is noted that the active portions of the piezoelectric actuator 40 are for applying pressure to the inks stored in the respective pressure chambers so as to eject the inks.

The piezoelectric actuator 40 has a construction in which piezoelectric sheets (made of a piezoelectric material) and film-like electrodes are alternately stacked on each other. The active portions 41 are provided by sandwiched portions 41*a* of the piezoelectric sheets each of which is vertically sandwiched by and between electrodes 41*b* and 41*c*. The other active portions are provided like the active portions 41. The pressure chambers are formed in the cavity plate 31 and below the respective active portions. That is, pressure chambers 31*e* for applying the ejection pressure to the black ink are formed and arranged in the cavity plate 31 and below the respective active portions 41. Similarly, pressure chambers 31*f* for the yellow ink are formed and arranged below the respective active portions 42. The pressure chambers 31*g* (shown in FIG. 4) for the cyan ink and the pressure chambers 31*h* (shown in FIG. 4) for the magenta ink are formed and arranged in respective rows below the other active portions, respectively. Below the rows of the pressure chambers, there are formed common ink chambers for supplying the inks to the respective pressure chambers. The common ink chambers are formed in the manifold plates 35, 34 so as to extend over the entire length of the rows of the pressure chambers. That is, common chambers 35*a*, 34*a* for storing the black ink are formed in the manifold plates 35, 34 and below the rows of the pressure chambers 31*e*. Common chambers 35*b*, 34*b* for storing the yellow ink are formed in the manifold plates 35, 34 and below the row of the pressure chambers 31*f*. Common chambers 35*c*, 34*c* (shown in FIG. 4) for storing the cyan ink are formed in the manifold plates 35, 34 and below the row of the pressure chambers 31*g*. Common chambers 35*d*, 34*d* (shown in FIG. 4) for storing the magenta ink are formed in the manifold plates 35, 34 and below the row of the pressure chambers 31*h*.

The supply plate 33 is disposed over the common ink chambers 34*a*-34*d*. In the supply plate 33, restrictor portions 33*e*, 33*g*, 33*j*, 33*m* are formed in correspondence with the respective pressure chambers. The restrictor portions, each having a recessed shape, are formed in a flat upper surface of the supply plate 33. Each of the restrictor portions communicates, at one of opposite end portions thereof from which the ink flows in, with a corresponding one of the common ink chambers via a corresponding one of communication holes vertically formed through the supply plate 33. The base plate 32 is superposed on the supply plate 33 and covers openings of the respective restrictor portions, each of which extends in its longitudinal direction. Communication holes 32*e*, 32*g*, 32*j*, 32*m* are vertically formed through the base plate 32. Each of the restrictor portions communicates, at the other of opposite end portions thereof from which the ink flows out, with a corresponding one of the pressure chambers via a corresponding one of the communicating holes.

Each restrictor portion has a smaller vertical cross-sectional area than the corresponding pressure chamber. Thus, resistance against ink flow is larger in the restrictor portions than in the common ink chambers and the pressure chambers. That is, the restrictor portions function to reduce pressure fluctuations generated in the pressure chambers each of which communicates with the corresponding restrictor portion and moving toward the common ink chambers.

In a lower surface of the damper plate 36, damper chambers 36*a*, 36*b*, 36*c*, 36*d* are formed at positions respectively corresponding to the common ink chambers. The damper chambers 36*a*-36*d* are open downward. Each damper chamber 36*a*-36*d* has the same horizontal cross-sectional shape as that of a lower portion of the corresponding common ink chamber which is adjacent to the damper plate 36.

The damper plate 36 is formed of an elastically deformable material such as a metal. The damper plate 36 has thin plate-like bottom plate portions 36*e* providing upper sides of the respective damper chambers. The bottom plate portions 36*e* can freely vibrate in upward and downward directions, namely, toward the common ink chambers and toward the damper chambers. If, upon ejection of the ink droplets, the pressure fluctuations generated in the pressure chambers are propagated to the common ink chambers, the bottom plate portions 36*e* are elastically deformed and vibrated. This deformation and vibrations lead to absorption and reduction of the pressure fluctuations, that is, a damper effect is exhibited. As a result, a cross talk in which the pressure fluctuations generated in one of the pressure chambers are propagated to other pressure chambers is prevented.

Through holes for introducing the inks stored in the pressure chambers to the nozzles are formed through each plate 32-37 between the cavity plate 31 and the nozzle plate 38. The through holes are divided into groups in each of which the through holes vertically communicate with each other. That is, there are vertically formed through holes 32*f*-37*f* for introducing the black ink stored in the pressure chambers 31*e* to the nozzles 38*f*, through holes 32*h*-37*h* for introducing the yellow ink stored in the pressure chambers 31*f* to the nozzles 38*h*, through holes 32*i*-37*i* for introducing the cyan ink stored in the pressure chambers 31*g* to the nozzles 38*i*, and through holes 32*n*-37*n* for introducing the magenta ink stored in the pressure chambers 31*h* to the nozzles 38*n*. The through holes designated with the same alphabet vertically communicate with each other (32*f* to 37*f*/32*h* to 37*h*/32*i* to 37*i*/32*n* to 37*n*).

As shown in FIG. 4, ink supply holes 31*a*-31*d* are formed in the cavity plate 31 for supplying the inks supplied from the buffer tank 90 (shown in FIG. 3) to the corresponding common ink chambers. Communicating holes 32*a*-32*d* and 33*a*-33*d* are respectively formed in the base plate 32 and the supply plate 33 for communicating the ink supply holes 31*a*-31*d* with the corresponding common ink chambers. The ink supply holes 31*a*-31*d* of the cavity plate 31 are covered with a filter member 59 having filters 61, 62, 63, 64 for filtering out foreign substances contained in the respective inks.

[Construction for Measuring Thickness of Adhesive Layer]

FIG. 6A is an explanatory view of the head unit 30 to which the reinforcing plate 60 is adhered, as seen from a lower side of the head unit 30. FIG. 6B is a cross-sectional view showing a cross section of FIG. 6A taken along a line A-A with a portion thereof omitted. As shown in FIG. 6B, an adhesive sheet 2 is interposed between an upper surface 31*i* of the head unit 30 and a lower surface 60*h* of the reinforcing plate 60. A non-adhesive area 2*a*, as an aperture, in which no adhesive exists is formed near an end portion of the adhesive sheet 2. The non-adhesive area 2*a* is formed in the adhesive sheet 2 in advance as its structure.

As shown in FIG. 6B, a space S1 used to measure the thickness of the adhesive layer 2 is formed in a portion of the cavity unit 50 in which the ink flow channels including the nozzles and the pressure chambers are not formed. The space S1 is constituted by openings formed through the respective plates 31-37 (i.e., the seven plates other than the nozzle plate 38) and arranged in a direction in which these plates are stacked. The nozzle plate 38 is formed of a material which can transmit light or beam (e.g., a laser beam) for measurement, and covers one of opposite ends of the arrangement of the openings. That is, a surface of the nozzle plate 38, namely, the nozzle surface 38*p* has a measuring window 38*r* provided at a position corresponding to the space S1 and optically communicating therewith. The measuring window 38*r* may be an opening formed through the nozzle plate 38, but preferably is formed of the above-described material to prevent the inks from entering into the space S1. In view of the above-described constructions, the head unit 30 may be considered to include a light-transmitting portion which transmits light and has the space S1. The space S1 communicates, at the other of opposite ends thereof which is located opposite to the measuring window 38*r*, with a portion of the reinforcing plate 60 which is adjacent to the non-adhesive area 2*a*. A through hole 31*k* is formed through the cavity plate 31 located at a position nearest to the reinforcing plate 60 in the cavity unit 50. The space S1 communicates with the portion of the reinforcing plate 60 via the through hole 31*k*. The through hole 31*k* may be considered to be a portion of the space S1. The through hole 31*k* has a smaller diameter than the remaining portion of the space S1. A portion of the cavity plate 31 which functions as a wall defining the through hole 31*k* is protruded as a protruding portion 31*j* into the space S1. It is noted that the through holes constituting the space S1 and formed through the respective plates may be formed through the respective plates in advance before stacking of the plates, and may be formed at the same time when those plates are stacked on and bonded to each other.

In view of the above, the ink-jet recording apparatus 1 can be considered to include a measuring section for estimating the thickness D4 of the adhesive layer 2 by using the non-adhesive area 2*a*. (An estimating method of the thickness D4 will be described below in detail.) More specifically, the measuring section can be considered to include the light-transmitting portion having the space S1.

[Method for Measuring Thickness of Adhesive Layer]

A first distance D1 from the nozzle surface 38*p* to the lower surface 60*h* of the reinforcing plate 60, namely, a thickness of the cavity unit 50 including the adhesive layer 2 is measured through the measuring window 38*r* by using the space S1, more specifically, by using the space S1 and the through hole 31*k*. Next, a distance from the nozzle surface 38*p* to a lower surface of the protruding portion 31*j* of the cavity plate 31, namely, a thickness D2 which is a thickness of the cavity unit 50 exclusive of a thickness of the cavity plate 31 (i.e., a thickness D3) is measured through the measuring window 38*r* by using the space S1. The thickness D3 of the cavity plate 31 is a designed or pre-set value, or a value individually measured in advance. A sum of the thickness D2 measured in the manner described above and the thickness D3 of the cavity plate 31 is the thickness of the cavity unit 50. The thickness of the adhesive layer (i.e., a thickness D4) is obtained by subtracting the second distance (D2+D3) from the first distance D1. In this embodiment, the first distance D1 and the distance D2 are measured with a laser measuring instrument, for example. A position (i.e., a reference position) from which the laser beam is emitted is set at the measuring window 38*r*, namely, at an outer surface of the nozzle plate 38*p*. As indicated by an arrow F1 in FIG. 6B, the first distance D1 is measured by vertically emitting the laser beam through the space S1 and the measuring window 38*r* to a portion of the lower surface of the reinforcing plate 60 which is adjacent to the non-adhesive area 2*a*. As indicated by an arrow F2, the distance D2 is measured by vertically emitting the laser light through the space S1 and the measuring window 38*r* to the lower surface of the protruding portion 31*j*.

Effects of the First Embodiment

As described above, the ink-jet recording apparatus 1 as the first embodiment includes the space S1 communicating the nozzle surface 38*p* of the head unit 30 with the portion of the reinforcing plate 60 that is adjacent to the non-adhesive area 2*a*. Thus, the first distance D1 from the nozzle surface 38*p* to the portion of the reinforcing plate 60 can be measured through the space S1. That is, the distance equal to the sum of the thickness of the adhesive layer 2 and the thickness of the cavity unit 50 can be obtained by the actual measurement. In addition, the cavity plate 31 includes the protruding portion 31*j* protruding into the space S1, so that the thickness D2 of the cavity unit 50 exclusive of the thickness D3 of the cavity plate 31 can be obtained by determining the distance from the nozzle surface 38*p* to the protruding portion 31*j* by the actual measurement. Then, the thickness D3 of the cavity plate 31 is added to the thickness D2, thereby determining the thickness of the cavity unit 50 as the second distance (D2+D3). Then, the thickness D4 of the adhesive layer 2 interposed between the cavity unit 50 and the reinforcing plate 60 can be obtained or estimated by subtracting the second distance (D2+D3) from the first distance D1.

That is, the thickness D4 of the adhesive layer 2 can be accurately obtained by determining the thickness D2 of the cavity unit 50 exclusive of the thickness D3 of the cavity plate 31 and determining the thickness D1 of the cavity unit 50 including the adhesive layer 2, each by the actual measurement. This measurement is not affected by variations in thickness of the plate members of the cavity unit 50 and variations in thickness of the adhesive layers each interposed between adjacent two of the plate members. Thus, the thickness D4 of the adhesive layer 2 can be accurately obtained. In addition, the above-mentioned distances are measured by using the space S1 and the protruding portion 31*j* formed in the head unit 30. Thus, this measurement is not affected by a warp of an end portion of the reinforcing plate 60, which leads to accurate obtainment of the thickness D4 of the adhesive layer 2.

Second Embodiment

Figure 7A:
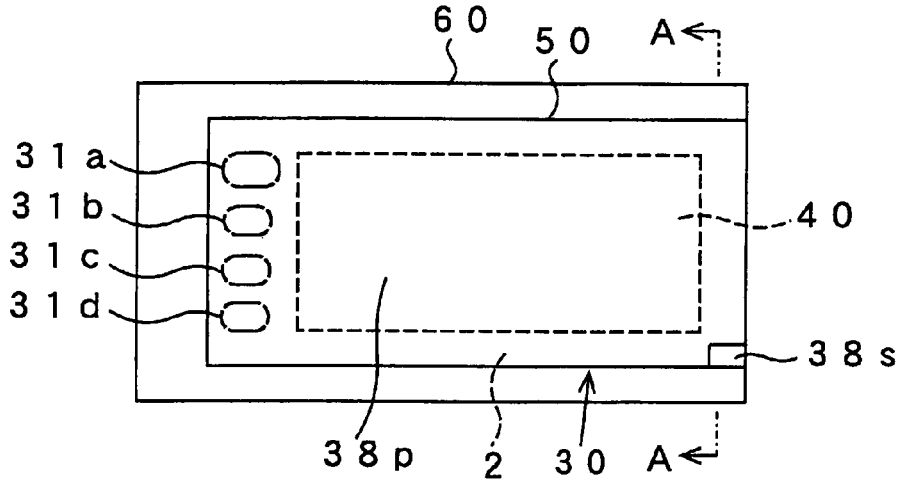
FIG. 7A is an explanatory view of a head unit of a second embodiment to which a reinforcing plate is adhered, as seen from a lower side of the head unit.
Figure 7B:
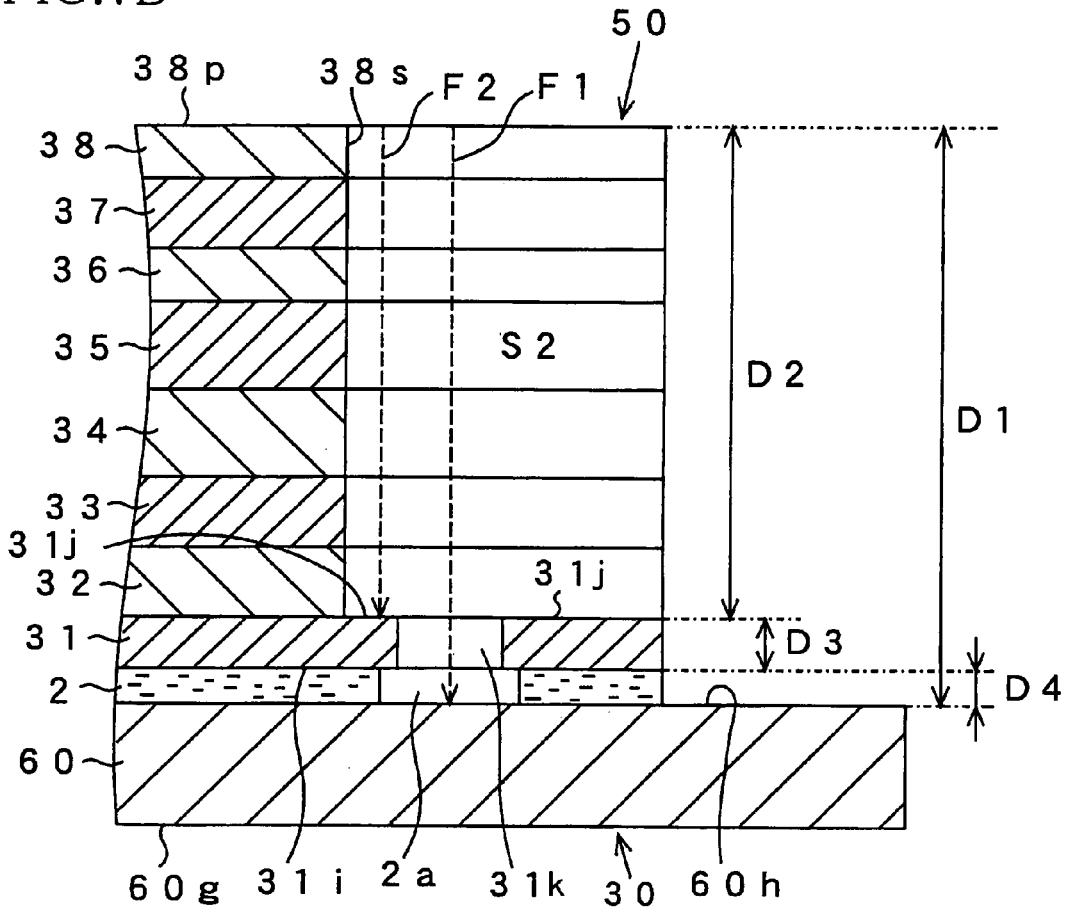
FIG. 7B is a cross-sectional view showing a cross section of FIG. 7A taken along a line A-A with a portion thereof omitted.

Next, there will be explained a second embodiment of the present invention with reference to the drawings. FIG. 7A is an explanatory view of the head unit 50 to which the reinforcing plate 60 is adhered, as seen from a lower side of the head unit 50. FIG. 7B is a cross-sectional view showing a cross section of FIG. 7A taken along a line A-A with a portion thereof omitted.

As shown in FIG. 7A, a measuring window 38*s* which is used to measure the thickness of the adhesive layer 2 is formed by cutting away a corner portion of the nozzle surface 38*p* of the cavity unit 50. The piezoelectric actuator 40 and the nozzles are not provided in the corner portion. As shown in FIG. 7B, a space S2 communicating with the measuring window 38*s* is formed by cutting away respective corner portions of the plates 32-38. A corner portion of the cavity plate 31 which is not cut away protrudes as the protruding portion 31*j*, from one side of the head unit 30 under the lower surface 60*h* of the reinforcing plate 60. The through hole 31*k* communicating with the space S2 is vertically formed through the protruding portion 31*j*. The non-adhesive area 2*a* as an aperture is formed, at a position corresponding to the through hole 31*k*, in the adhesive layer 2 interposed between the cavity unit 50 and the reinforcing plate 60. The space S2 extends to a portion of the reinforcing plate 60 that is adjacent to the non-adhesive area 2*a*, through the through hole 31*k* of the protruding portion 31*j*. It is noted that the protruding portion 31*j* may have a smaller plan-view area than the measuring window 38*s*. In this case, the space S2 extends to the reinforcing plate 60 through a position adjacent to the protruding portion 31*j* in its plan view. In addition, the measuring window 38*s* may be formed in an end portion of the cavity unit 50 different from the corner portion thereof. In view of the above, the head unit 30 can be considered to include the light-transmitting portion having the space S2.

[Method for Measuring Thickness of Adhesive Layer]

The first distance D1 from the nozzle surface 38*p*, as a reference position, to the lower surface 60*h* of the reinforcing plate 60, namely, the thickness of the cavity unit 50 including the adhesive layer 2 is measured through the measuring window 38*s* by using the space S2 and the through hole 31*k*. Next, the distance from the nozzle surface 38*p* to the lower surface of the protruding portion 31*j* of the cavity plate 31, namely, the thickness D2 of the cavity unit 50 exclusive of the thickness D3 of the cavity plate 31 is measured through the measuring window 38*s* by using the space S2. Then, the thickness D4 of the adhesive layer 2 is obtained or estimated by subtracting the second distance (D2+D3) from the first distance D1. Each distance may be measured with the laser measuring instrument as described above in the first embodiment.

Effects of the Second Embodiment

As described above, in the ink-jet recording apparatus 1 as the second embodiment, the corner portion of the cavity plate 31 protrudes as the protruding portion 31*j* from one side of the cavity unit 50 under the lower surface 60*h* of the reinforcing plate 60. Thus, if the distance from the nozzle surface 38*p* to the lower surface of the protruding portion 31*j* is measured, the thickness D2 of the cavity plate 50 exclusive of the thickness of the cavity plate 31 can be obtained. Then, the thickness D3 of the cavity plate 31 is added to the thickness D2, so as to determine the thickness of the cavity unit 50 as the second distance (D2+D3). In addition, the cavity plate 31 has the through hole 31*k* formed through the protruding portion 31*j* and communicating with the portion of the reinforcing plate 60 that is adjacent to the non-adhesive area 2*a*. Thus, the first distance D1 from the nozzle surface 38*p* to the portion of the reinforcing plate 60 can be measured through the through hole 31*k*. That is, the thickness of the cavity unit 50 and the thickness of the cavity unit 50 including the adhesive layer 2 via which the reinforcing plate 60 is adhered to the cavity unit 50 can be measured. Then, the second distance (D2+D3) is subtracted from the first distance D1, so as to obtain the thickness D4 of the adhesive layer 2 interposed between the cavity plate 50 and the reinforcing plate 60.

That is, the thickness D2 of the cavity unit 50 exclusive of the thickness of the cavity plate 31 and the thickness D1 of the head unit 30 including the adhesive layer 2 are determined by the actual measurements, which leads to accurate obtainment of the thickness D4 of the adhesive layer 2. This measurement is not affected by variations in thickness of the plate members of the cavity unit 50 and variations in thickness of the adhesive layers each interposed between adjacent two of the plate members. Thus, the thickness D4 of the adhesive layer 2 can be accurately obtained. The distance D1 and the distance D2 are measured by using the protruding portion 31*j* of the cavity plate 31 which protrudes from one side of the head unit 30 under the lower surface 60*h* of the reinforcing plate 60, and the through hole 31*k* formed through the cavity plate 31. Thus, this measurement is not affected by the warp of the end portion of the reinforcing plate 60, which leads to more accurate obtainment of the thickness D4 of the adhesive layer 2.

Third Embodiment

Figure 8A:
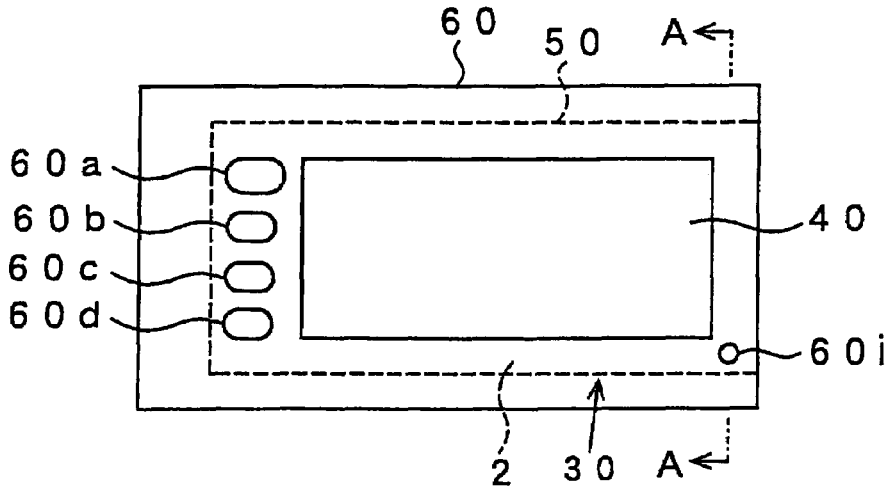
FIG. 8A is an explanatory view of a head unit of a third embodiment to which a reinforcing plate is adhered, as seen from an upper side of the head unit.
Figure 8B:
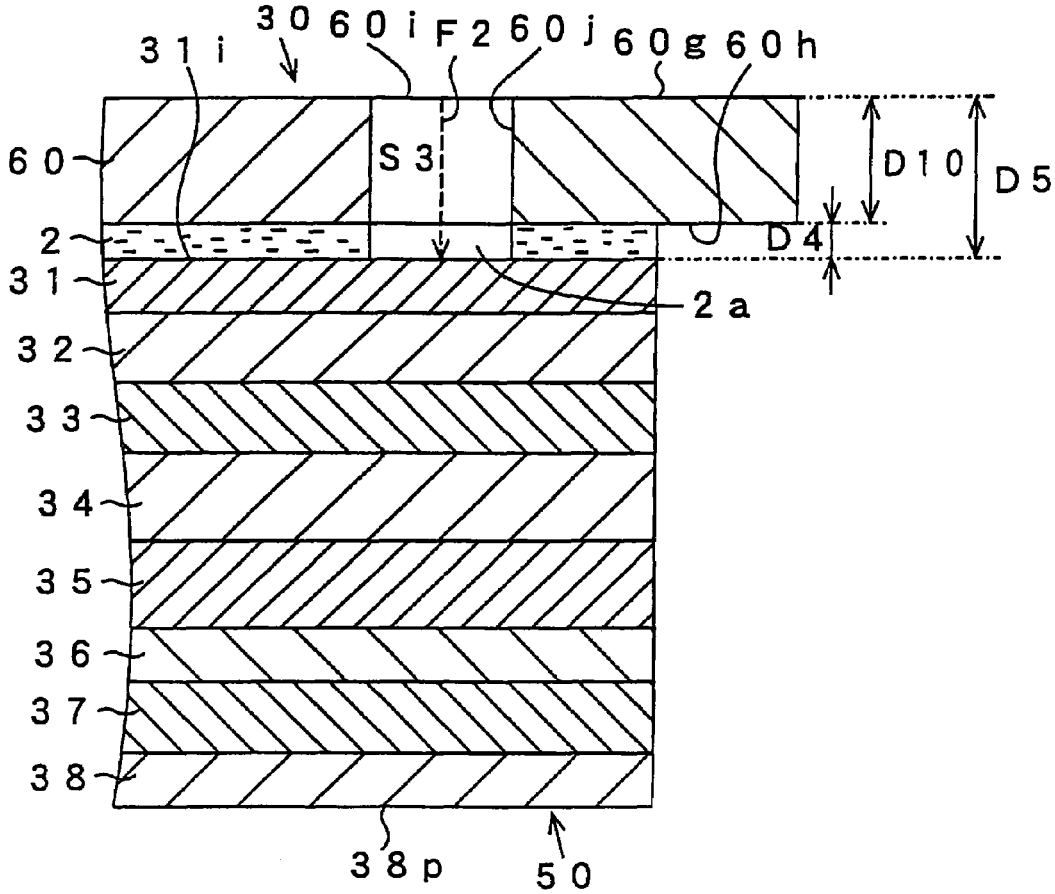
FIG. 8B is a cross-sectional view showing a cross section of FIG. 8A taken along a line A-A with a portion thereof omitted.

Next, there will be explained a third embodiment of the present invention with reference to the drawings. FIG. 8A is an explanatory view of the head unit 30 to which the reinforcing plate 60 is adhered, as seen from an upper side of the head unit 30. FIG. 8B is a cross-sectional view showing a cross section of FIG. 8A taken along a line A-A with a portion thereof omitted.

As shown in FIG. 8A, a measuring window 60*i* which is used to measure the thickness of the adhesive layer 2 is open in a corner portion of the reinforcing plate 60 which overlaps the cavity unit 50 and in which the ink flow channels are not provided in the cavity unit 50. As shown in FIG. 8B, a through hole 60*j* communicating with the measuring window 60*i* and the non-adhesive area 2*a* is vertically formed through the reinforcing plate 60. The through hole 60*j* and the non-adhesive area 2*a* define a space S3. In other words, this construction can be considered that the measuring section includes the through hole 60*j*. In addition, in this third embodiment, as viewed in a direction perpendicular to the upper surface of the cavity plate 31, the cavity plate 31 is smaller than the reinforcing plate in dimensions, and the reinforcing plate 60 is adhered to the cavity unit 50 such that the cavity plate 31 is projected within the reinforcing plate 60.

[Method for Measuring Thickness of Adhesive Layer]

A first distance D5 from an upper surface 60*g* of the reinforcing plate 60 to the upper surface 31*i* of the cavity plate 31, namely, a thickness of the reinforcing plate 60 including the adhesive layer 2 is measured through the measuring window 60*i* by using the space S3. Then, a thickness of the adhesive layer 2 (i.e., a thickness D4) is obtained or estimated by subtracting a second distance D10 as a thickness of the reinforcing plate 60 (which is a designed or preset value, or a value individually measured in advance) from the first distance D5.

Effects of the Third Embodiment

As described above, the space S3 communicating the upper surface 60*g* of the reinforcing plate 60 and a portion of the head unit 30 which is adjacent to the non-adhesive area 2*a* is provided in the ink-jet recording apparatus 1 as the third embodiment. Thus, the first distance D5 from the upper surface of the reinforcing plate 60 to the portion of the head unit 30 can be obtained through the space S3 by the actual measurement. That is, the thickness of the reinforcing plate 60 including the adhesive layer 2 via which the reinforcing plate 60 is adhered to the head unit 30 can be measured. Then, the second distance D10 as the thickness of the reinforcing plate 60 is subtracted from the first distance D5, so as to obtain the thickness D4 of the adhesive layer 2 interposed between the head unit 30 and the reinforcing plate 60.

Since the thickness of the reinforcing plate 60 including the adhesive layer 2 is determined by the actual measurement, the thickness D4 of the adhesive layer 2 can be accurately obtained. In addition, the first distance D5 is measured by using the space S3 communicating the upper surface 60*g* of the reinforcing plate 60 with the portion of the head unit 30 which is adjacent to the non-adhesive area 2*a*. Thus, this measurement is not affected by the warp of the end portion of the reinforcing plate 60, which leads to more accurate obtainment of the thickness D4 of the adhesive layer 2.

Figure 9A:
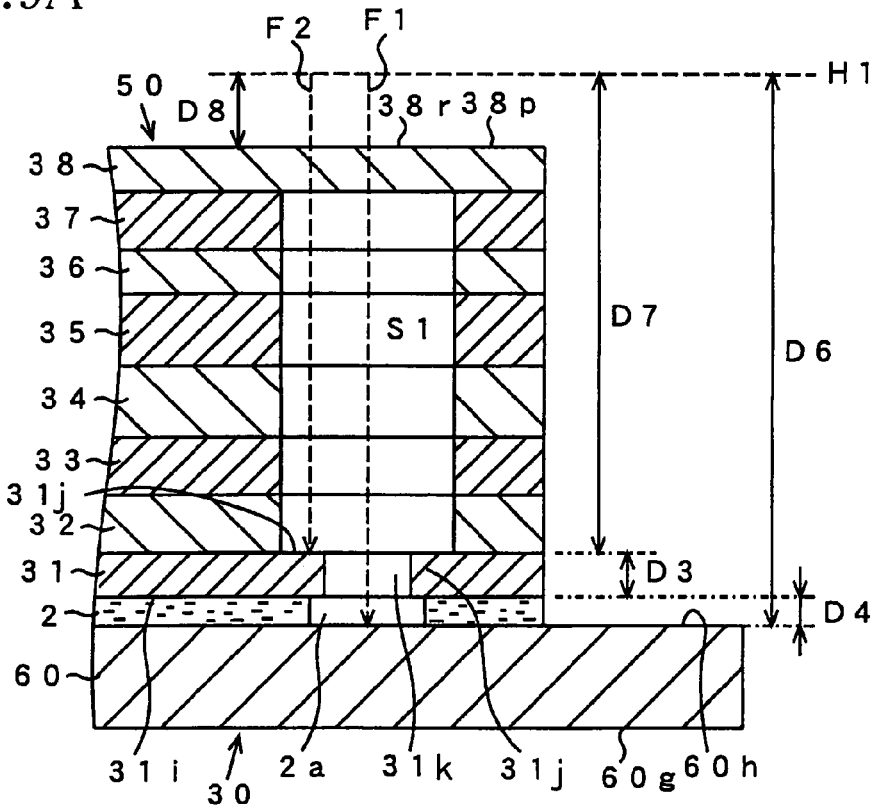
FIG. 9A is a cross-sectional view showing a modification of the first embodiment.

Other Embodiments (1) FIG. 9A is a cross-sectional view showing a modification of the first embodiment. Although a reference position used to measure the first and second distances is, in the first embodiment, set at a position of the nozzle surface 38*p* at which the measuring window 38*r* is located, a reference position H1 is, in this modification, set at a position higher than the measuring window 38*r* by a distance D8.

[Method for Measuring Thickness of Adhesive Layer]

Initially, a first distance D6 from the reference position H1 to the lower surface 60*h* of the reinforcing plate 60 is measured by using the space S1, more specifically, by using the space S1 and the through hole 31*k*. Next, a distance D7 from the reference position H1 to the lower surface of the protruding portion 31*j* of the cavity plate 31 is measured by using the space S1. A second distance (D3+D7) is obtained by adding the thickness D3 of the cavity plate 31 to the distance D7. Then, the thickness D4 of the adhesive layer 2 is obtained by subtracting the second distance (D3+D7) from the first distance D6. The same effects as those explained in the first embodiment can be obtained in this measuring method. It is noted that, also in the second embodiment, the thickness D4 of the adhesive layer 2 can be obtained by determining each distance from a reference position set at a position higher than the measuring window 38*s* by the actual measurement. Thus, the same effects as those explained in the second embodiment can be obtained in this measuring method.

Figure 9B:
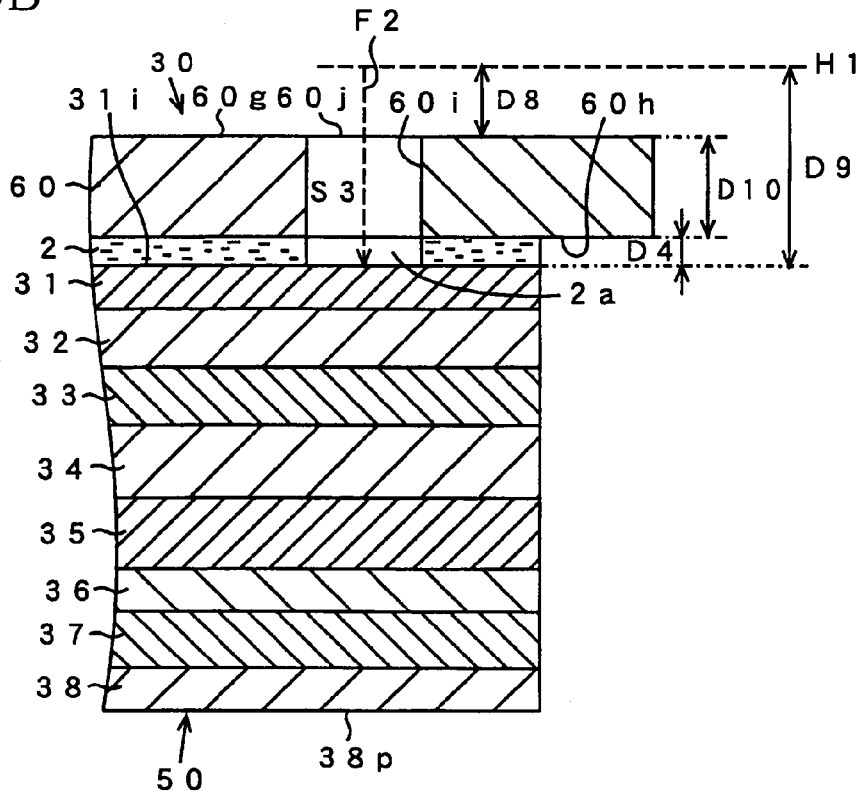
FIG. 9B is a cross-sectional view showing a modification of the third embodiment.
Figure 10A:
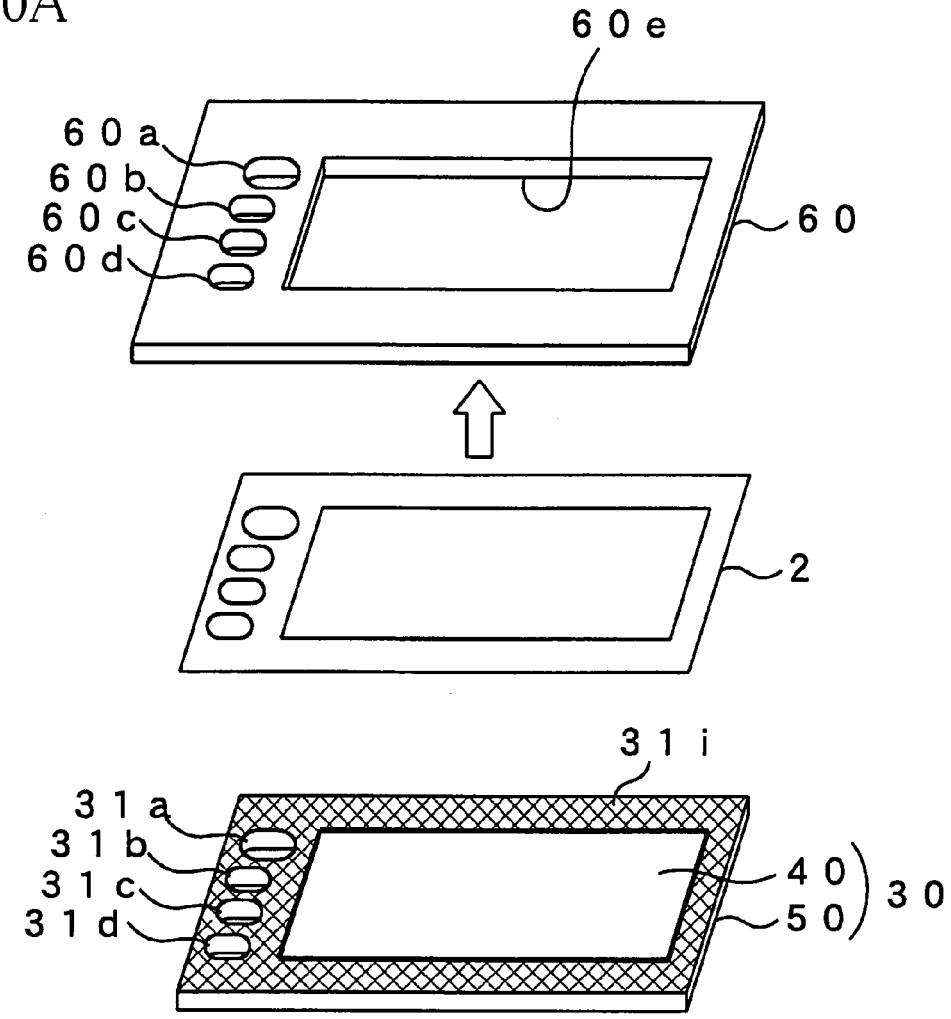
FIG. 10A is an explanatory view of a head unit and a reinforcing plate of a conventional ink-jet recording apparatus.
Figure 10B:
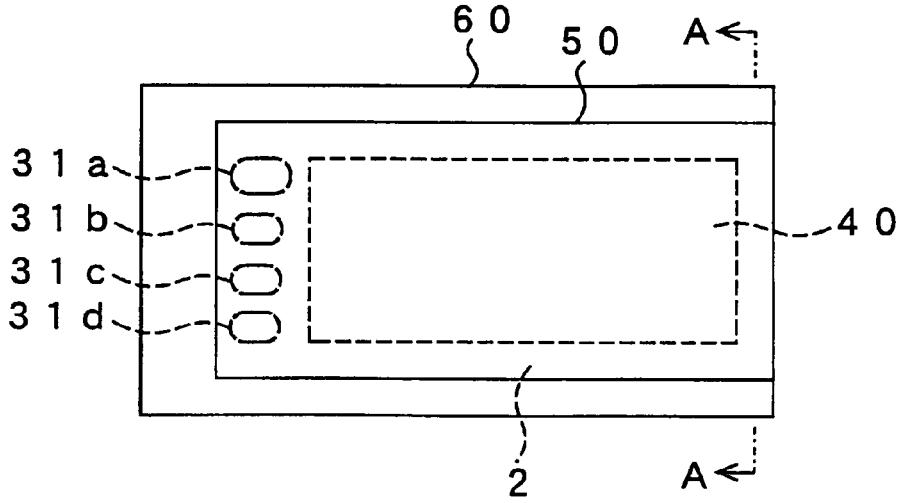
FIG. 10B is an explanatory view of the head unit to which the reinforcing plate is adhered, as seen form a lower side of the head unit.
Figure 11A:
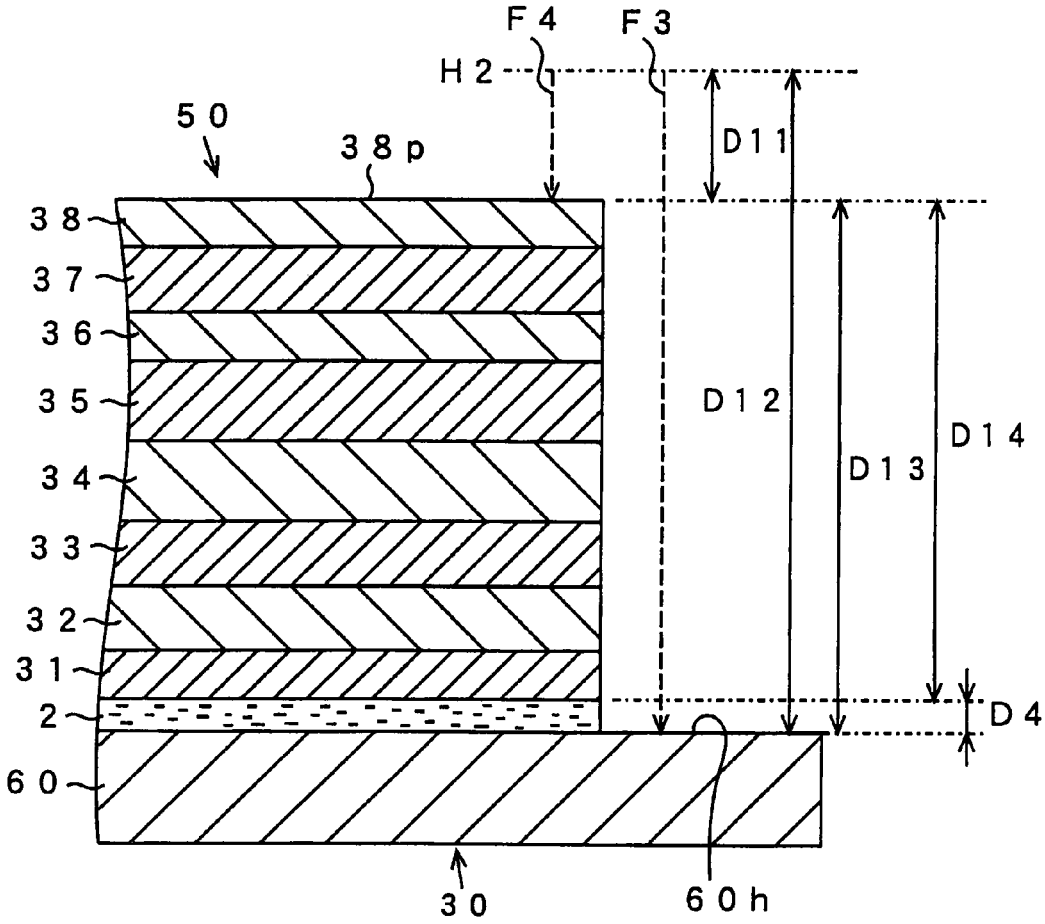
FIG. 11A is a cross-sectional view showing a cross section of FIG. 10B taken along a line A-A with a portion thereof omitted.
Figure 11B:
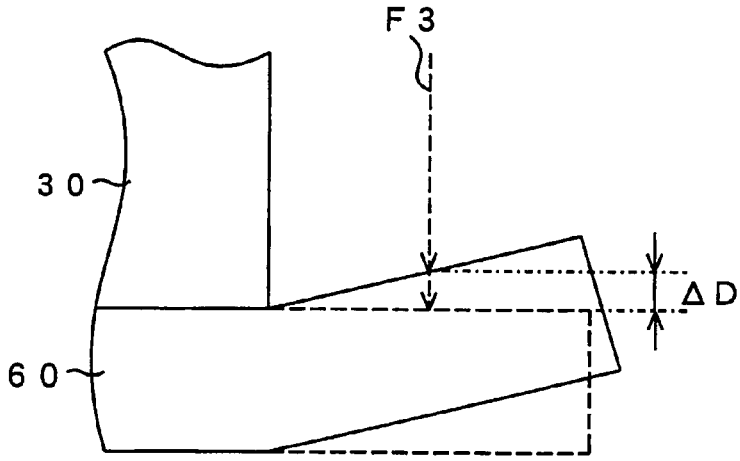
FIG. 11B is an explanatory view of the reinforcing plate that is upwardly warped at its end portion.

(2) FIG. 9B is a cross-sectional view showing a modification of the third embodiment. Although a reference position used to measure the first distance is, in the third embodiment, set at a position of the upper surface 60*g* at which the measuring window 60*i* is located, a reference position H1 is, in this modification, set at a position higher than the measuring window 60*i* by a distance D8.

[Method for Measuring Thickness of Adhesive Layer]

A first distance D9 from the reference position H1 to the upper surface 31*i* of the cavity plate 31 is obtained by using the space S3 by the actual measurement. Then, the thickness D4 of the adhesive layer 2 is determined by subtracting, from the first distance D9, a second distance obtained by adding the distance D8 to the thickness D10 of the reinforcing plate 60. The distance D8 is a distance from the reference position to the upper surface of the reinforcing plate 60 and can be obtained by the actual measurement with the laser measuring instrument. The same effects as those explained in the third embodiment can be obtained in this measuring method.

(3) The above-described embodiments relate to the ink-jet recording apparatus as an example of the droplet ejecting apparatus of the present invention. However, it should be understood that the present invention may be applied to a droplet ejecting apparatus which ejects a liquid different from ink.

(4) Further, the present invention may be applied to an ink-jet recording apparatus in which a single sort of ink is ejected to perform a recording operation.

(5) Furthermore, the present invention may be applied to a head unit which ejects liquid droplets (e.g., ink droplets) using a pressure fluctuation caused by air bubbles generated in the liquid, owing to heat energy given to the liquid, or using a displacement of a vibration plate caused by static electricity, and so on.

What is claimed is:

1. A droplet ejecting apparatus, comprising:

a head unit including (a) a cavity unit constituted by a plurality of plate members stacked on each other and adhered to each other with an adhesive, having a first outer surface and a second outer surface respectively defined by a first outermost plate member and a second outermost plate member of the plurality of plate members which are opposite to each other and one of which has a plurality of nozzles, and having a plurality of liquid flow channels formed therein and respectively communicating with the plurality of nozzles, and (b) an actuator attached to the cavity unit and operable such that the head unit ejects droplets through the plurality of nozzles;

a holder which holds the head unit;

a reinforcing plate which is adhered to the cavity unit of the head unit so that the holder holds the head unit;

an adhesive layer interposed between the first outer surface of the cavity unit and a first surface of the reinforcing plate as one of opposite surfaces thereof so as to adhere the cavity unit and the reinforcing plate to each other, and having a non-adhesive area in which no adhesive exists; and a measuring section configured such that a measurement for estimating a thickness of the adhesive layer by using the non-adhesive area is performed therein.

2. The droplet ejecting apparatus according to claim 1, wherein the measuring section is configured such that a measurement by using an optical technique as the measurement for estimating the thickness of the adhesive layer is performed therein.

3. The droplet ejecting apparatus according to claim 1, wherein the measuring section includes a through hole provided in the first outermost plate member at a position corresponding to the non-adhesive area of the adhesive layer, and is configured such that a measurement by using the through hole as the measurement for estimating the thickness of the adhesive layer is performed in the measuring section.

4. The droplet ejecting apparatus according to claim 3, wherein the measuring section includes a light-transmitting portion which transmits light, which is provided in the plurality of plate members exclusive of the first outermost plate member, and which is configured such that the first surface of the reinforcing plate is optically recognizable through the through hole of the first outermost plate member and the non-adhesive area of the adhesive layer from an outside of the second outer surface of the cavity unit, and such that at least a part of an area, surrounding the through hole, of a back surface of the first outermost plate member opposite to a surface thereof providing the first outer surface of the cavity unit is optically recognizable from the outside of the second outer surface of the cavity unit.

5. The droplet ejecting apparatus according to claim 4, wherein the light-transmitting portion includes a space which is formed through at least a part of the plurality of plate members exclusive of the first outermost plate member and within which the at least the part of the area, surrounding the through hole, of the back surface of the first outermost plate member and at least a part of the through hole of the first outermost plate member are projected as viewed in a direction perpendicular to the first outer surface of the cavity unit.

6. The droplet ejecting apparatus according to claim 4, wherein the first outermost plate member has a protruding portion protruding from an outer edge of a portion of the cavity unit which is formed by stacking the plurality of plate members exclusive of the first outermost plate member, as viewed in the direction perpendicular to the first outer surface of the cavity unit, wherein the through hole is provided in the protruding portion, and wherein the light-transmitting portion includes a space provided on a side of the back surface of the protruding portion.

7. The droplet ejecting apparatus according to claim 1, wherein the measuring section includes a through hole provided in the reinforcing plate at a position corresponding to the non-adhesive area of the adhesive layer, and wherein a measurement by using the through hole, as the measurement for estimating the thickness of the adhesive layer, is performed in the measuring section.

8. The droplet ejecting apparatus according to claim 7, wherein as viewed in the direction perpendicular to the first outer surface of the cavity unit, the first outermost plate member is smaller than the reinforcing plate in dimensions, and the reinforcing plate is adhered to the cavity unit such that the first outermost plate member is projected within the reinforcing plate.

9. A method for estimating the thickness of the adhesive layer of the droplet ejecting apparatus according to claim 3, comprising steps of:

measuring, in the measuring section, a distance to the first surface of the reinforcing plate from a reference position that is not nearer to the reinforcing plate than the second outer surface of the cavity unit, in a direction perpendicular to the first outer surface of the cavity unit;

measuring, in the measuring section, a distance from the reference position to a back surface of the first outermost plate member opposite to a surface thereof providing the first outer surface of the cavity unit, in the direction perpendicular to the first outer surface of the cavity unit; and estimating the thickness of the adhesive layer based on the measured distance to the first surface of the reinforcing plate from the reference position, the measured distance from the reference position to the back surface of the first outermost plate member, and a thickness of the first outermost plate member.

10. A method for estimating the thickness of the adhesive layer of the droplet ejecting apparatus according to claim 7, comprising steps of:

measuring, in the measuring section, a distance to the first outer surface of the cavity unit from a reference position that is not nearer to the cavity unit than a second surface of the reinforcing plate opposite to the first surface thereof, in a direction perpendicular to the first outer surface of the cavity unit;

measuring, in the measuring section, a distance from the reference position to the second surface of the reinforcing plate, in the direction perpendicular to the first outer surface of the cavity unit; and estimating the thickness of the adhesive layer based on the measured distance to the first outer surface of the cavity unit from the reference position, the measured distance from the reference position to the second surface of the reinforcing plate, and a thickness of the reinforcing plate.

11. A method for estimating the thickness of the adhesive layer of the droplet ejecting apparatus according to claim 7, comprising steps of:

measuring, in the measuring section, a distance to the first outer surface of the cavity unit from a second surface of the reinforcing plate opposite to the first surface thereof, in a direction perpendicular to the first outer surface of the cavity unit; and estimating the thickness of the adhesive layer based on the measured distance to the first outer surface of the cavity unit from a second surface of the reinforcing plate and a thickness of the reinforcing plate.

* * * * *